United States Patent [19]

Stone

[11] Patent Number: 4,974,585

[45] Date of Patent: Dec. 4, 1990

[54] BREATHING APPARATUS GAS-ROUTING MANIFOLD

[75] Inventor: William C. Stone, Derwood, Md.

[73] Assignee: Cis-Lunar Development Laboratories, Derwood, Md.

[21] Appl. No.: 340,260

[22] Filed: Apr. 19, 1989

[51] Int. Cl.[5] ..... A62B 7/10

[52] U.S. Cl. ..... 128/205.120; 128/205.280; 128/201.250

[58] Field of Search ..... 128/205.12, 205.23, 128/205.24, 205.28, 207.12, 204.28, 206.25, 201.25

[56] References Cited

U.S. PATENT DOCUMENTS

| | | | |
|---|---|---|---|
| 3,352,304 | 11/1967 | Bartlett, Jr. | 128/205.12 |
| 3,973,562 | 8/1976 | Jansson | 128/205.12 |
| 4,273,120 | 6/1981 | Oswell | 128/205.12 |
| 4,428,372 | 1/1984 | Beysez et al. | 128/205.12 |
| 4,498,470 | 2/1985 | Warncue | 128/205.12 |
| 4,522,639 | 6/1985 | Ansite et al. | 128/205.12 |
| 4,794,923 | 1/1989 | Bartos | 128/205.12 |

FOREIGN PATENT DOCUMENTS

| | | | |
|---|---|---|---|
| 197803 | 7/1978 | Fed. Rep. of Germany | 128/205.12 |
| 365762 | 1/1932 | United Kingdom | 128/205.12 |
| 799635 | 8/1958 | United Kingdom | 128/205.12 |

*Primary Examiner*—Eugene H. Eickholt

*Attorney, Agent, or Firm*—Marks Murase & White

[57] ABSTRACT

An integrated, improved, fully redundant mixed gas breathing apparatus gas routing manifold permits inhalation and exhalation lines from both mouthpieces of a closed circuit breathing system and an automatic gas addition system to be cross routed to the opposite system's $CO_2$ removing and gas control system.

21 Claims, 5 Drawing Sheets

FIG. 3
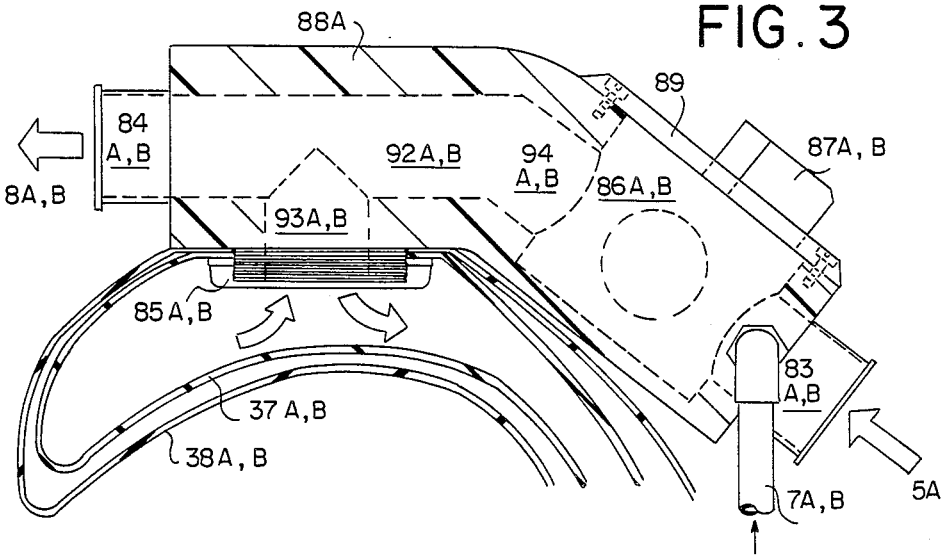
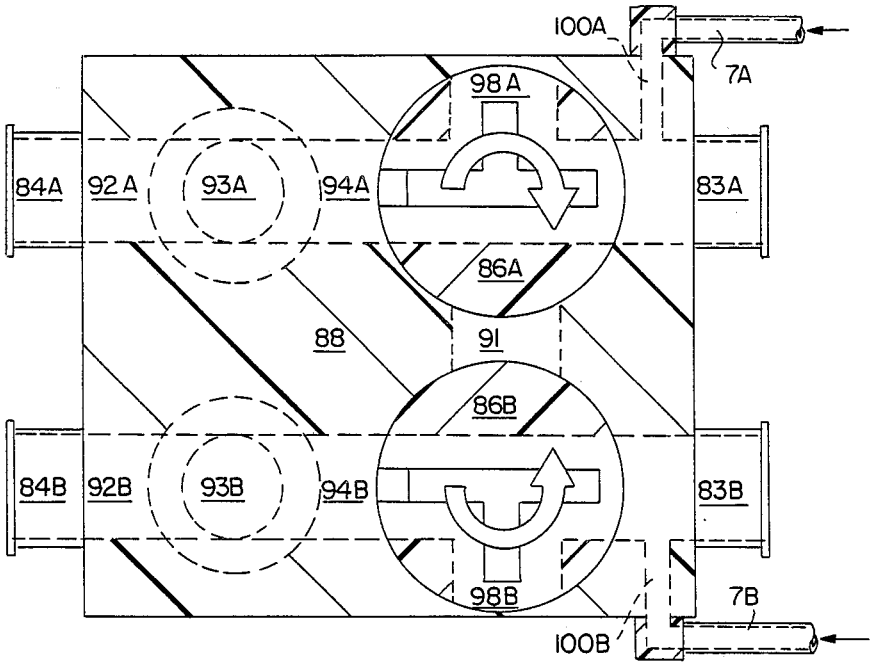
FIG. 4

BREATHING APPARATUS GAS-ROUTING MANIFOLD

CROSS-REFERENCE TO RELATED APPLICATIONS

Reference is made to applicant's co-pending applications Ser. Nos. 340,250 and 340,251 entitled "Breathing Apparatus Mouthpiece" and "Breathing Apparatus", respectively both filed on Apr. 19, 1989.

FIELD OF THE INVENTION

The present invention relates to portable life support systems used to sustain human respiration in locations where exposure to the environment would be fatal and in particular where there is a lack of immediate recourse to a safe-haven. These portable life support systems are free of safety umbilicals and larger environmentally controlled structures.

BACKGROUND OF THE INVENTION

Portable life support systems are used in a variety of situations in which the ambient environment around the user cannot be breathed either because of the lack of oxygen in usable form or because of the presence of substances which would have toxic effects if inhaled. These uses include extravehicular activity in space, scuba diving, including deep off-shore diving work, use in contaminated atmospheres, use at high altitudes and the like.

The two fundamental architectures in the design of portable life support apparatus are open circuit and closed circuit systems. Open circuit systems, typified by the underwater diving system popularized by Jacques Cousteau, are the simplest, consisting of a compressed gas supply and a demand regulator from which the user breathes. The exhaust gas is ported overboard with each breath, hence the name "open" circuit. These systems are bulky and inefficient in that the oxygen not absorbed during each breath is expelled and wasted. Additionally failure of any component results in failure of the system.

Closed circuit systems, also known as rebreathers, make nearly total use of the oxygen content of the supply gas by removing the carbon dioxide generated by the user, and adding makeup oxygen or oxygen containing gas to the system when the internal volume drops below a set minimum level, or when the oxygen partial pressure drops below some pre-established setpoint.

These closed circuit breathing systems generally consist of a mouthpiece from which the user breathes and which is connected by means of two flexible impermeable hoses, one to remove the exhaled gas and the other to return the processed gas, to a means for removing the carbon dioxide from the breathing gas, replenishing metabolized oxygen, and providing for makeup gas volume with a breathable gas to maintain system volume during descent as the gases within the breathing circuit are compressed. Such devices are usually provided with a series of checkvalves located near the mouthpiece such that gas flow within the breathing circuit is always maintained in a single direction. Oxygen addition to the system may be made by oxygen generators, such as the type disclosed in U.S. Pat. No. 2,710,003, to Hamilton et al., or the addition of oxygen or an oxygen containing gas either through a constant mass flow orifice or by means of a manually operated or a sensor-controlled electronic valve.

Gas addition closed circuit systems may be one of two types, a pure oxygen version, which is limited to operating environments where the partial pressure of oxygen is less than two atmospheres, and a mixed gas version, normally used for underwater work at great depths. From a control standpoint, oxygen rebreathers are quite simple and require no active control. Mixed gas rebreathers, on the other hand, are considerably more complex. These were first pioneered in the late 1960's in an effort to solve the problems of narcosis at depths and to eliminate the oxygen toxicity problems which limit the safe diving depth of pure oxygen rebreathers.

When breathing in a closed circuit system, the exhaled breathing gas is held in a closed container, such as a breathing bag or a counterlung. Work is done when the gas is exhaled into, or inhaled from, the counterlung since surrounding environment is displaced as the counterlung is expanded. It has now been discovered that the work of breathing is dependent upon the user orientation angle and is directly related to static lung loading, which is the vertical distance, in centimeters of water, from the user's or "diver's" suprasternal notch, and the center of gravity of the inflated counterlung. Further, lung physiology prefers a slight positive pressure during inhalation, such as a static lung loading of between 0 to +10 centimeters of water. The present invention is the first to appreciate that known rebreathers with back-mounted counterlungs have negative static lung loadings and thus difficult inhalation characteristics while those that are chest-mounted have positive static lung loadings well in excess of +10 centimeters of water, and thus have hard exhalation characteristics. Furthermore, it has also been discovered that these known counterlungs are very sensitive to the user orientation angle due to the location of the center of gravity of these counterlungs.

In the prior art manual bypass valves, which permit the user to manually add either oxygen or an oxygen containing gas to the breathing circuit in the event of failure of the automatic valves, if present, have been placed on the body of the rebreather. For the case of a back-mounted rebreather, such as that shown in U.S. Pat. No. 3,710,553, these valves require an awkward reverse reach in order to operate them.

The major deficiencies and problems existing with these known systems include a lack of redundancy or safety, limited duration or range, excess weight, high breathing resistance, and difficult manual operation.

A major leak anywhere in the breathing circuit of existing rebreathers leads to a subsequent flooding of the carbon dioxide removal system and therefore failure of the breathing apparatus. For operations conducted in locations where an immediate abort to a safe environment is impossible, such a failure could result in the death of the diver.

SUMMARY OF THE INVENTION

The present invention provides an integrated, improved, fully redundant mixed gas breathing apparatus which solves the specific problems described above. In particular, the present invention provides a gas-routing manifold which permits inhalation and exhalation lines from both mouthpieces and an automatic gas addition line to be cross routed to the opposite system's carbon dioxide removing and gas control systems.

BRIEF DESCRIPTION OF THE DRAWING

The invention is further described by way of the illustrative examples with reference to the drawings, in which:

FIG. 3 is a side sectional view of the gas routing manifold depicted in FIG. 2;

FIG. 4 is a top sectional view of the gas routing manifold depicted in FIG. 2;

DETAILED DESCRIPTION OF THE INVENTION

Figure 1:
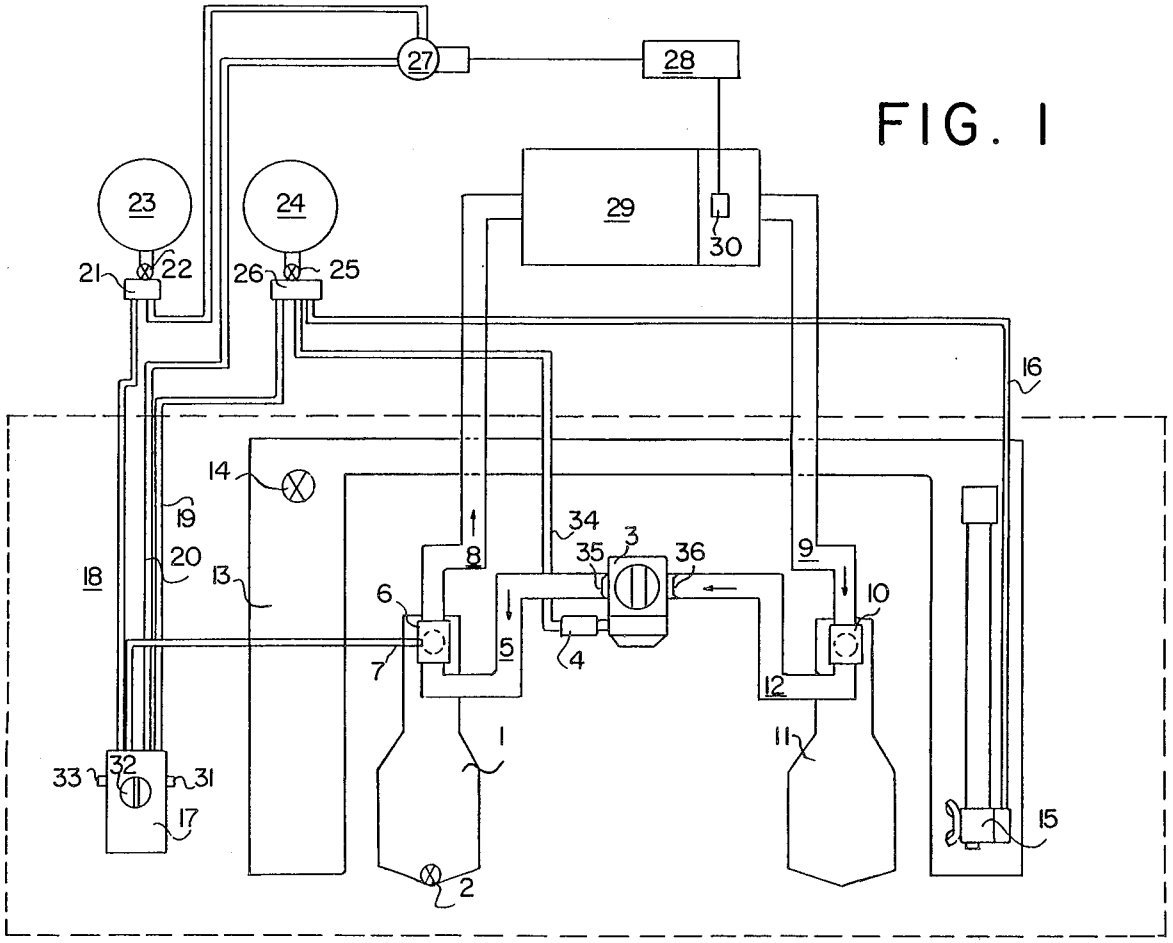
FIG. 1 is a schematic representation of a fully redundant breathing apparatus using the gas routing manifold of the present invention.

A fully redundant breathing apparatus, such as that shown schematically in FIG. 1, and which are the subject of my co-pending application Serial No. 340,251, entitled BREATHING APPARATUS, filed on even date herewith, requires switchable routing of the gas flows so as to be able to bypass any non-functioning or malfunctioning component of the breathing apparatus. Such routing is achieved by means of the gas routing manifold of the present invention.

The fully-redundant sensor-controlled closed-circuit mixed-gas breathing apparatus schematically shown in FIG. 1, is composed of two integrated closed-circuit systems indicated in the drawings as A or B, respectively.

In accordance with the invention, the fully-redundant breathing apparatus is provided with two mouthpieces into which the user can alternate breathing. An example of such a mouthpiece that may be used is the subject of my co-pending application filed even date herewith, Ser. No. 340,250, entitled BREATHING APPARATUS MOUTHPIECE, and which is incorporated herein by reference. The flow of the breathing gas is preferably constrained in the direction of the arrows by checkvalves 35A and 36A on the exhale and inhale sides of mouthpiece 3A respectively, and by checkvalves 35B and 36B on the respective exhale and inhale sides of mouthpiece 3B. Upon exhalation, the flow from each mouthpiece is directed through its respective hose, either 5A or 5B, into exhaust routing manifold 88A mounted on the user's right hand side.

For ease of description, the operation of only one closed-circuit system will be described. The exhaled gas is routed from manifold 88A into counterlung 1, which preferably has a capacity one half the volume of gas exhaled by the user, generally about 3 to about 3.5 liters. The volume, shape and type of counterlung used may vary depending upon the ambient environment and pressure. Advantageously, the counterlung has the configuration described in my co-pending application, Ser. No. 340,251, entitled BREATHING APPARATUS, filed on even date herewith, and which is incorporated herein by reference. The exhaled gas in excess of that held by counterlung 1 flows through hose 8 and into a chamber 29 which contains a carbon dioxide removal system. The cleansed gas then continues through hose 9, into manifold 10, and consequently into counterlung 11, which comprises the second half of the counterlung volume. This completes the exhalation cycle. Upon inhalation the gas in the left hand counterlung 11 is breathed through hose 12, checkvalve 36 into mouthpiece 3 until counterlung 11 collapses at which point the volume of counterlung 1 is drawn through the carbon dioxide removal system 29, through hose 9, and directly through manifold 10 to hose 12 which completes the process circuit to mouthpiece 3. During normal operation of the apparatus oxygen is metabolized by the user and converted to carbon dioxide which is subsequently removed from the system. Provided depth is not increasing during this time, the partial pressure of oxygen will begin to decrease. Advantageously, there is provided an electrochemical sensor 30, or series of said sensors to detect the partial pressure of $O_2$ and provide information to an electronic decision making module 28 which may be either analog or digital. When the partial pressure of oxygen indicated by sensor(s) 30 falls below some pre-established setpoint (0.7 atmospheres is a common value) the electronic control system 28 opens an electronic valve 27 which subsequently preferably permits a quantity of pressurized oxygen to be sent down a small diameter low pressure supply line 20 to the manual override control panel 17. The pressurized oxygen supply which feeds electronic valve 27 preferably consists of a high pressure vessel 23, a shut-off valve 22, and a first regulator 21 which reduces the pressure to a value acceptable by electronic valve 27 (10 bar is typical). In accordance with the invention, the flow of oxygen from electronic valve 27 to the breathing circuit may be stopped by the diver at any time by closing manual valve 32 located in the center of the manual override panel 17, irrespective of whether valve 27 is open. This feature permits the diver to take direct intervention and stop the flow of oxygen to the breathing circuit in the event of a failure of electronic valve 27 in the open position. A second low pressure oxygen line 18 carries oxygen directly from regulator 21 to the manual override control panel 17. There lever 33, when depressed, actuates a manually operated valve which permits the diver to manually add gas to the system and continue operation in closed-circuit mode, even following failure of electronic valve 27. In a similar manner, diluent gas (for example air, helium-oxygen, nitrox, trimix) is provided for the system by means of a high pressure vessel 24, a shut-off valve 25, and a regulator 26 which reduces the pressure to a value typically supplied to second stage open-circuit regulators (10 bar is typical). Preferably, two low pressure, small diameter lines carry gas to the breathing circuit from the diluent supply. Line 34 connects the low pressure diluent output from regulator 26 with an adjustable, in-line control valve 4 which permits the user to adjust the pressure drop required to open a second stage open-circuit valve which is integrated into mouthpiece 3. Adjustable valve 4 is designed such that the flow through feed line 34 may be completely shut off, thus allowing the user to stop a free flowing second stage valve in mouthpiece 3 without having to close the high pressure shut-off valve 25. Furthermore, an additional low pressure line 19 connects diluent regulator 26 to the manual override control panel 17. By depressing lever 31 the user can manually add diluent to the system irrespective of whether or not adjustable valve 4 is closed. The output from the manual override control (which includes oxygen delivered from electronic valve 27) is sent via a single low pressure line 7 to manifold 6 where it is injected into the closed-circuit process loop. Entry of supply gases (oxygen and diluent) at this location ensures complete mixing prior to inhalation by the user.

The user may convert mouthpiece 3 to function as an open-circuit second stage regulator with no connection to the closed circuit process loop. Advantageously, there is provided a relatively large capacity diluent bottle 24 (or an external diluent supply) to supply the user with sufficient diluent in a integral open-circuit mode for a significant amount of time to enable the user to effect a recovery from a total closed-circuit malfunction.

Advantageously, counterlungs 1 and 11 can be designed to form the front panels of a vest. The back panel of the vest may be comprised of a bouyancy compensator 13 which may be fabricated in any shape, preferably in a horseshoe shape similar to known back mounted bouyancy compensators used for open-circuit diving, except that it forms an integral portion of a hybrid vest. The bouyancy compensator portion of the vest is preferably equipped with an oral/automatic inflator hose 15 for which low pressure diluent gas is advantageously supplied by low pressure line 16. Feed line 16 may be connected to a source of diluent gas by means of diluent regulator 26, an auxiliary external inflator bottle and regulator, not shown, or the like. Since both counterlungs 1 and 11, as well as bouyancy compensator 13, could burst due to expansion of gases during ascent, pressure relief valves 2 and 14 are advantageously provided for venting of the counterlungs and bouyancy compensator portions of the vest, respectively.

The flow in the two independent closed-circuit systems A and B must be co-rotational. The reason for this requirement is that the exhaled gases from both mouthpieces, 3A and 3B, are connected to an exhalation routing manifold 88A, mounted on the user's right shoulder, which permits the user to re-route the flow of the exhaled gas from any of the mouthpieces 3A or 3B to its opposite system gas processing unit. A similar inhalation routing manifold 88B is provided on the user's left shoulder such that the output from either gas processing system can be routed to any of mouthpieces 3A or 3B. It may be appreciated that the terms "left shoulder" and "right shoulder" described above are relative only and that these titles can be interchanged, provided correct continuity is maintained with respect to gas flow direction.

Figure 2:
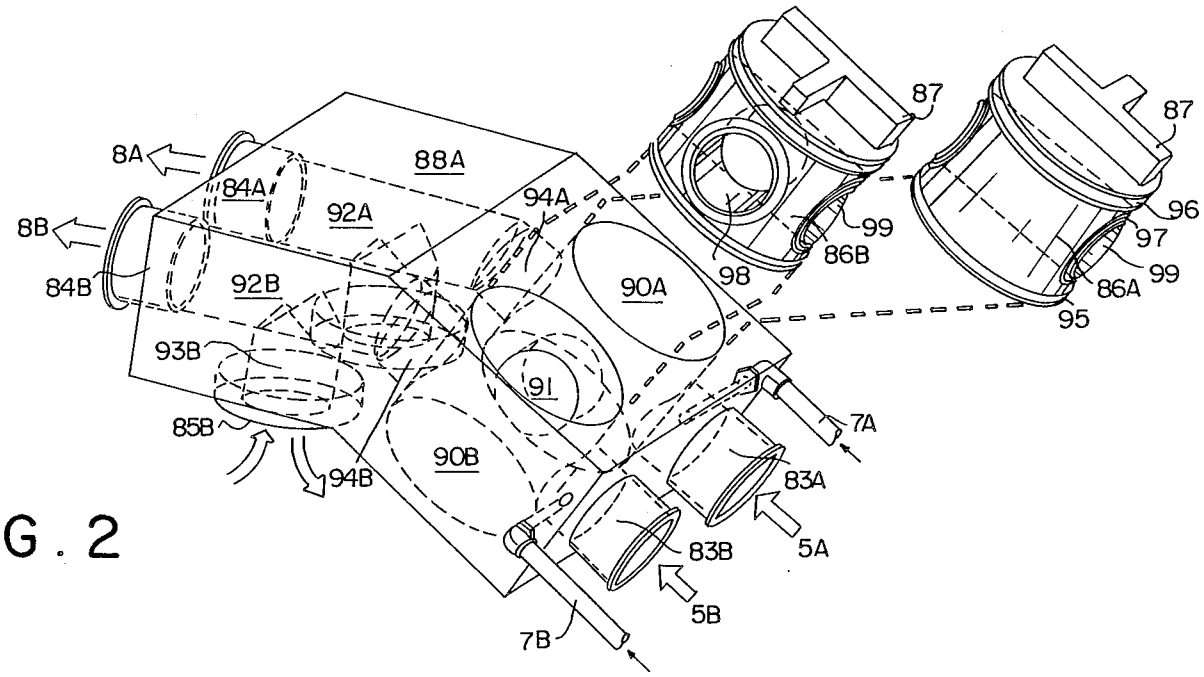
FIG. 2 is an exploded perspective view of the gas routing manifold of the present invention.

FIGS. 2 through 7 describe the gas routing manifold in detail. FIG. 2 is an exploded perspective view of the exhalation manifold wherein exhalation hoses 5A and 5B are connected, respectively, to manifold ports 83A and 83B which in turn provide access to two large diameter cylindrical cavities 90A and 90B oriented perpendicular to the top face of the manifold 88A. Leaving cavities 90A and 90B are inclined boreholes 94A and 94B, respectively, which join with horizontal boreholes 92A and 92B, respectively which join to exterior ports 84A and 84B, respectively, which carry the exhaled gases to hoses 8A and 8B, respectively. Manifold 88A is connected to counterlungs lA and IB respectively through vertical ports 85A and 85B which are sealingly connected to the inner gas bags in each respective counterlung. Vertical boreholes 93A and 93B connect the interior of the gas bags to the horizontal boreholes 92A and 92B, such that exhaled gas in excess of that required to fill the inner gas bag may pass directly through said manifold and into hose 8A or 8B which carries the exhaled gas to its respective carbon dioxide scrubber 29A or 29B, depicted in FIG. 1.

In accordance with the invention, cross-routing of exhaust gases through manifold 88A is accomplished by means of special cylindrical three-way valves 86A and 86B which nest inside cavities 90A and 90B, respectively. The fabrication and sealing technology associated with valves 86A and 86B preferably includes cylindrical o-ring seals 95 and 96 at the bottom and top of each of valves 86A and 86B to prevent intrusion of water into the manifold and the unwanted bypass of gases from, for example, ports 83 to boreholes 94. Valves 86A and 86B are identical and include a borehole 99 which passes through the valve wall perpendicular to the major axis of the cylinder and a second side borehole 98 which is also perpendicular to the axis of borehole 99 and is only deep enough to provide a clear connection with borehole 99 and the wall of the cylinder. Each of the three holes in the side face of valves 86A and 86B are sealed by means of o-ring grooves and o-rings 97 which surround the holes and yet also conform to the surface curvature of the cylinder. A "T" handle, projecting from the top face of valves 86A and 86B advantageously indicates the orientation of the internal boreholes 98 and 99. The ability to cross-route gases through manifold 88A depends on the presence of a cross borehole 91 which connects cavities 90A and 90B as shown in FIGS. 15 through 20. The orientation of valves 86A and 86B, as will be described in subsequent detail, determines whether or not any cross-routing of breathing gas takes place.

In accordance with the invention, the low pressure supply lines 7A and 7B from manual override control panels 17A and 17B, respectively, are connected to ports 83A and 83B, respectively, such that manually supplied oxygen, diluent, and automatically supplied oxygen for each respective supply and control system are injected into manifold 88A prior to encountering the routing valves 86A and 86B, respectively. This feature permits not only exhaled breathing gas to be cross-routed to an alternate carbon dioxide processing system, but also for the manual override controls to route supply gases to the alternate gas processing system. The significance of this that, for example, if all supply gases in system A have been exhausted, yet the carbon dioxide scrubber 29A still has useful life, the diver may gain significant extra time underwater by routing mouthpiece 3B into carbon dioxide scrubber 29A, provided supply gas still exists in system B. It may be appreciated that the inhalation routing manifold 88B is identical to that depicted in FIGS. 2 through 7 with the exception that the bulkhead penetrations 100A and 100B (FIG. 17) are not required.

FIGS. 3 and 4 present section and plan views which serve to clarify the operation of manifold 88A depicted in FIG. 2. FIG. 3 shows valves 86A and 86B inserted into cavities 90A and 90B, respectively and prevented from being accidentally removed by retainer plate means 89. FIG. 4 shows a plan view of manifold 88A with valves 86A and 86B installed.

Figure 5:
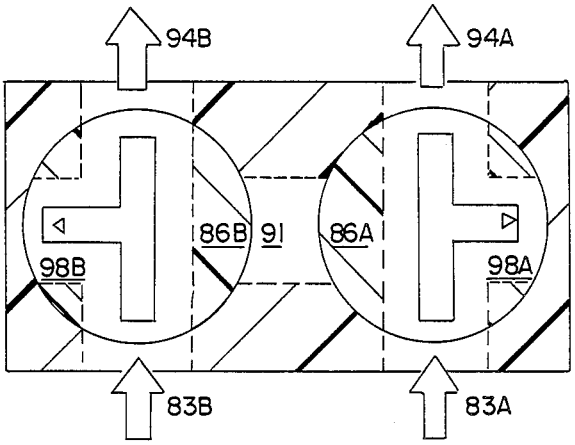
FIG. 5 is a top sectional view of the valves of the gas routing manifold of FIG. 2 shown in normal operation with no cross-routing of the gases.
Figure 6:
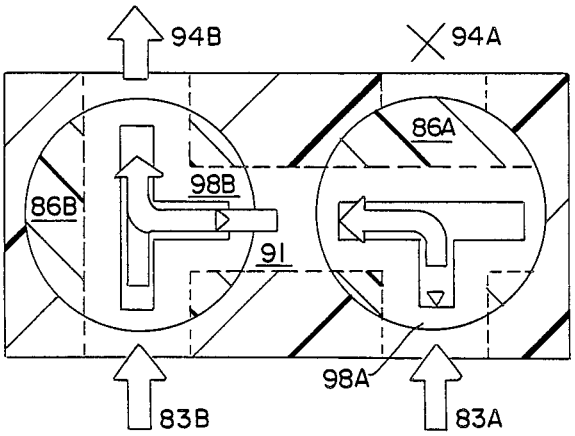
FIG. 6 is a top sectional view of the valves of FIG. 5 shown with routing of the gases from both mouthpieces to one regeneration system.
Figure 7:
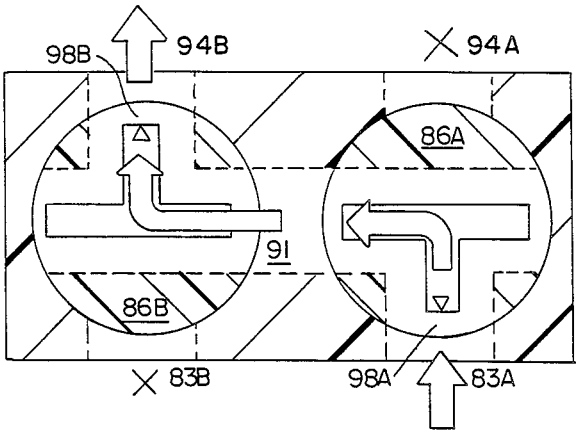
FIG. 7 is a top sectional view of the valves of FIG. 5 shown with cross-routing of the gases from one mouthpiece to the other regeneration system.
Figure 8:
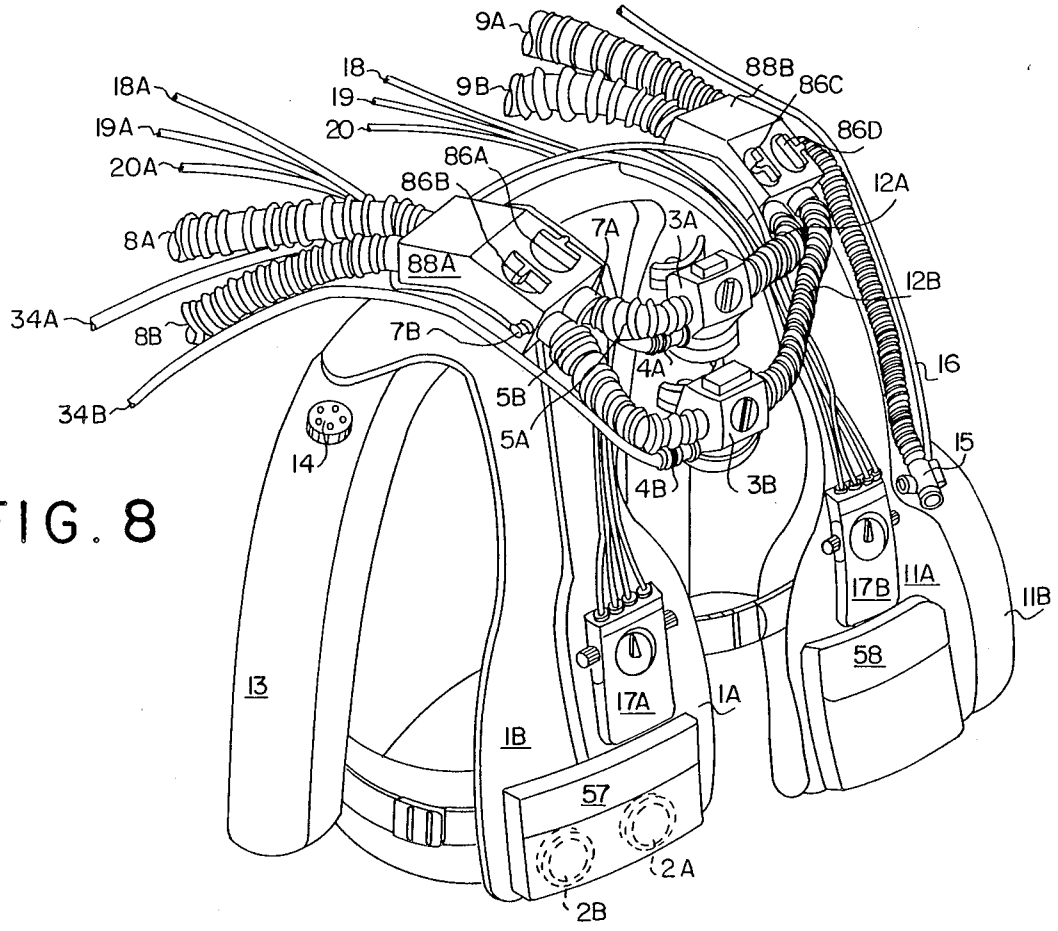
FIG. 8 is a perspective view of the gas routing manifold of the present invention incorporated into a fully redundant breathing apparatus.

FIG. 5 shows the respective positions of valves 86A and 86B during normal operation in which no cross-routing of gases takes place. In this position the system behaves identically to a bi-linear closed-circuit system. FIG. 6 shows that the exhaled gases from mouthpiece 3A, which are connected to port 83A, are routed, along with the exhaust gases from mouthpiece 3B, which is connected to port 83B, to internal borehole 94B. In this fashion both mouthpieces 3A and 3B access carbon dioxide removal and oxygen control system B simultaneously. FIG. 7 shows a similar situation to that depicted in FIG. 6, with the exception that the exhalation flow from mouthpiece 3B, which is connected to port 83B, is completely blocked off. This may be desirable if a leak has occurred in mouthpiece B but the user needs the extra breathing time afforded by making use of carbon dioxide removal system B by means of mouthpiece 3A. Alternate positioning of valves 86A and 86B permit routing of gases from mouthpiece 3B to carbon dioxide processing system A. Advantageously, spring loaded catches are provided for valves 86A and 86B to lock them into the positions indicated so that accidental bumping during a dive will not cause undesirable shifting of the valve positions. Valve positions for the inhalation manifold 88B are identical to those for manifold 88A. These valves are identified as 86C and 86D in FIG. 8, which provides a perspective view of the fully redundant embodiment of the invention.

It should be understood that the foregoing disclosure relates only to a preferred embodiment of the invention and that numerous modifications or alterations may be made therein without departing from the spirit and scope of the invention as set forth in the appended claims.

I claim:

1. A gas routing manifold for a breathing apparatus, said manifold comprising two entrance ports for admitting gas into said manifold each of said entrance ports being connected by means of two bore holes to two exit ports for exhausting gas from said manifold, two large diameter cylindrical cavities, oriented perpendicular to the face of the manifold, disposed in each of said bore holes; a third bore hold which connects said cylindrical cavities; and two cylindrical three-way valves disposed inside each of said cylindrical cavities, wherein said valves are switchably operable to be positioned so as to direct gas from either entrance port to either exit port.

2. A gas routing manifold for a breathing apparatus, said manifold comprising two gas flow paths, each comprising an entrance port for admitting gas into said manifold, an exit port for exhausting gas from said manifold, and two switchably operable valve means disposed in said flow paths, so that gas can be directed from either entrance port to either exit port and wherein each of the valve means has operative positions and can be spring-loaded locked to insure positioning in one of four operative positions.

3. A gas routing manifold for a breathing apparatus, said manifold comprising two gas flow paths, each comprising an entrance port for admitting gas into said manifold, an exit port for exhausting gas from said manifold, and two switchably operable valve means disposed in said flow paths, comprising internal bore holes so that gas can be directed from either entrance port to either exit port and wherein each of the valves has a T-handle projecting from a top face of said valve to indicate the orientation of the internal bore holes.

4. A manifold system for a breathing apparatus, wherein said breathing apparatus comprises a first breathing circuit comprising first mouthpiece means, first filter means, first connecting means for connecting an output side of said first mouthpiece means to an input side of said first filter means and second connecting means for connecting an output side of said first filter means to an input side of said first mouthpiece means; and a second breathing circuit comprising second mouthpiece means, second filter means, third connecting means for connecting an output side of said second mouthpiece means to an input side of said first filter means and fourth connecting means for connecting an output side of said second filter means to an input side of said second mouthpiece means; said manifold system comprising:

first selection means operatively connected to said first and third connecting means for selectively enabling said first mouthpiece means to be connected to said first or second filter means, and for selectively enabling said second mouthpiece means to be connected to said first or second filter means.

5. The system of claim 4 wherein said manifold system further comprises:

second selection means operatively connected to said second and fourth connecting means for selectively connecting said first filter means to said first or second mouthpiece means and for selectively connecting said second filter means to said first or second mouthpiece means.

6. The system of claim 5 wherein said first and second filter means comprise carbon dioxide removal devices and said first and second selection means each comprise a pair of three-way valves.

7. The system of claim 5 wherein said first and second selection means are operable to selectively connect;

said first mouthpiece means to said first filter means and said second mouthpiece means to said second filter means; or said first and second mouthpiece means to said first filter means; or said first and second mouthpiece means to said second filter means; or said first mouthpiece means to said second filter means and to isolate said second mouthpiece means from said system; or said second mouthpiece means to said first filter means and to isolate said first mouthpiece means from said system.

8. The system of claim 4 wherein said first selection means is operable to selectively connect:

said first mouthpiece means to said first filter means and said second mouthpiece means to said second filter means; or said first and second mouthpiece means to said first filter means; or said first and second mouthpiece means to said second filter means.

9. The system of claim 8 wherein said first selection means comprises first and second valve means, said first valve means being disposed in a first flow path, said second valve means being disposed in a second flow path, and a third flow path operatively connecting said first and second flow paths.

10. A gas routing manifold for a breathing apparatus comprising:

two entrance ports for admitting gas into said manifold;

two exit ports for exhausting gas from said manifold;

two gas flow paths through said manifold, each of said flow paths connecting one of said entrance ports to one of said exit ports, wherein each of said flow paths comprises valve seats;

a third gas flow path connecting said valve seats; and two three-way valves, wherein a three-way valve is disposed in each of said valve seat and may be selectively positioned to direct a flow of gas from either entrance port to either exit port.

11. The gas routing manifold of claim 10 wherein each of said three-way valves is sealingly connected to the manifold by cylindrical O-ring seals.

12. The gas routing manifold of claim 10 wherein each of said three-way valves is a cylindrical three-way valve with internal bores sealed by conformable O-ring seals.

13. The gas routing manifold of claim 10 further comprising at least one gas supply port connected to one of the entrance ports.

14. A gas routing manifold for a breathing apparatus, said manifold comprising a housing having first and second gas flow paths, each of said flow paths comprising an entrance port for admitting gas into said housing, an exit port for exhausting gas from said housing, a three-way valve disposed in each flow path between said entrance and exit ports, and a flow channel connecting said first and second flow paths, said valve being operable to selectively direct gas flow from either of said entrance ports to either of said exit ports.

15. The gas routing manifold of claim 14 further comprising at least one gas supply port connected to one of said entrance ports.

16. A gas routing manifold for a breathing apparatus having at least two mouthpieces and at least two carbon dioxide removal devices, said gas routing manifold comprising:

a gas flow path connecting each of said mouthpieces to said gas routing manifold;

a gas flow path connecting each of said carbon dioxide removal devices to said gas routing manifold; and valve means operatively disposed in said gas routing manifold for selectively connecting one or both of said mouthpieces to one of said carbon dioxide removal devices.

17. The gas routing manifold of claim 16 wherein said two entrance ports are each connected by means of a bore hold to a corresponding one of said two exit ports, each of said bore holes having a cylindrical valve seat therein, and further comprising a third bore hold connecting said cylindrical valve seats, and wherein said valve means comprises two cylindrical three-way valves disposed in each of said cylindrical valve seats for selectively directing gas from either one of said entrance ports to either one of said exit ports.

18. The gas routing manifold of claim 17 further comprising at least one gas supply port connected to one of the entrance ports.

19. The gas routing manifold of claim 16 wherein said valve means comprises two three-way valves having a plurality of discrete operative positions.

20. A gas routing manifold system for a breathing apparatus comprising two mouthpieces and two carbon dioxide removal devices; said system comprising:

a gas routing output manifold;

a gas routing input manifold;

a gas flow path connecting a downstream side of each of said mouthpieces to an upstream side of said output manifold;

a gas flow path connecting a downstream side of said output manifold with an upstream side of each of said carbon dioxide removal devices;

a gas flow path connecting a downstream side of said carbon dioxide removal devices with an upstream side of said input manifold; and a gas flow path connecting a downstream side of said input manifold with an upstream side of each of said mouthpieces.

21. A breathing apparatus comprising a gas routing manifold system and a closed circuit breathing system comprising two mouthpieces and two carbon dioxide removal devices, said gas routing manifold system comprising:

a gas routing output manifold;

a gas routing input manifold;

a gas flow path connecting a downstream side of each of said mouthpieces to an upstream side of said output manifold;

a gas flow path connecting a downstream side of said output manifold with an upstream side of each of said carbon dioxide removal devices;

a gas flow path connecting a downstream side of said carbon dioxide removal devices with an upstream side of said input manifolds; and a gas flow path connecting the downstream side of said input manifold with the upstream sides of each of said mouthpieces.

* * * * *